US011454148B2

(12) United States Patent
Yoon et al.

(10) Patent No.: US 11,454,148 B2
(45) Date of Patent: Sep. 27, 2022

(54) MUFFLER FOR VEHICLE FOR IMPLEMENTING SPORTY EXHAUST SOUND

(71) Applicants: HYUNDAI MOTOR COMPANY, Seoul (KR); KIA MOTORS CORPORATION, Seoul (KR)

(72) Inventors: Hyun-Woo Yoon, Suwon-si (KR); Keon-Woo Kim, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 201 days.

(21) Appl. No.: 16/815,335

(22) Filed: Mar. 11, 2020

(65) Prior Publication Data

US 2021/0131323 A1 May 6, 2021

(30) Foreign Application Priority Data

Oct. 31, 2019 (KR) ..... 10-2019-0137609

(51) Int. Cl.
*F01N 1/08* (2006.01)
*F01N 1/10* (2006.01)
(Continued)

(52) U.S. Cl.
CPC ..... *F01N 1/084* (2013.01); *F01N 1/10* (2013.01); *F01N 3/005* (2013.01); *F01N 1/006* (2013.01);
(Continued)

(58) Field of Classification Search
CPC ..... F01N 1/082; F01N 1/083; F01N 1/084; F01N 1/089; F01N 1/163; F01N 2470/14;
(Continued)

(56) References Cited

U.S. PATENT DOCUMENTS 5,477,015 A * 12/1995 Preslicka ..... B21D 39/04 181/243
5,563,385 A * 10/1996 Harwood ..... F01N 13/1877 181/282
(Continued)

FOREIGN PATENT DOCUMENTS

KR 100916809 B1 * 9/2009
KR 10-1268835 B1 5/2013
(Continued)

*Primary Examiner* — Jeremy A Luks
(74) *Attorney, Agent, or Firm* — Lempia Summerfield Katz LLC

(57) ABSTRACT

A muffler for a vehicle includes: a case sealed at both ends by first and second side panels; first and second baffle plates installed in the case; a first chamber formed between the first side panel and the first baffle plate; a second chamber formed between the first baffle plate and the second baffle plate; a third chamber formed between the second baffle plate and the second side panel; an intake tube passing through the first side panel, and the first and second baffle plates, and including a first hole formed in a first body section located in the first chamber, and a second hole formed in a second body section located in the second chamber; and a pair of exhaust tubes passing through the first and second baffle plates, and the second side panel, and including a vent hole formed in body section located in the second chamber.

7 Claims, 10 Drawing Sheets

(51) Int. Cl.
*F01N 3/00* (2006.01)
*F01N 1/00* (2006.01)

(52) U.S. Cl.
CPC ..... *F01N 2310/02* (2013.01); *F01N 2470/02* (2013.01); *F01N 2470/14* (2013.01)

(58) Field of Classification Search
CPC ..... F01N 2490/02; F01N 2490/06; F01N 2490/10; F01N 3/005
USPC ..... 181/239, 254
See application file for complete search history.

(56) References Cited

U.S. PATENT DOCUMENTS

| | | | | |
|---|---|---|---|---|
| 8,418,805 | B1 * | 4/2013 | Han | F01N 1/10 181/264 |
| 2004/0003963 | A1 * | 1/2004 | Worner | F01N 13/1872 181/239 |
| 2007/0125594 | A1 * | 6/2007 | Hill | F01N 1/084 181/256 |
| 2014/0054101 | A1 * | 2/2014 | Zhang | F01N 1/083 180/309 |
| 2019/0301323 | A1 * | 10/2019 | Ahn | F01N 1/083 |

FOREIGN PATENT DOCUMENTS

| | | | | |
|---|---|---|---|---|
| KR | 10-2013-0060839 | A | | 6/2013 |
| KR | 20150045703 | A | * | 4/2015 |
| KR | 10-1526753 | B1 | | 6/2015 |

* cited by examiner

FIG, 3B

MUFFLER FOR VEHICLE FOR IMPLEMENTING SPORTY EXHAUST SOUND

CROSS-REFERENCE TO RELATED APPLICATION

This application claims priority to and the benefit of Korean Patent Application No. 10-2019-0137609, filed on Oct. 31, 2019, the entire contents of which are incorporated herein by reference.

FIELD

The present disclosure relates to a muffler for a vehicle.

BACKGROUND

The statements in this section merely provide background information related to the present disclosure and may not constitute prior art.

Generally, exhaust gas that is emitted during the operation of an engine of a vehicle passes through a catalytic system that purifies components harmful to human bodies, such as carbon monoxide or nitrogen compounds, and then is transmitted through an exhaust system to a muffler.

The muffler functions to reduce the exhaust sound of the exhaust gas that is emitted by the vehicle. The muffler basically includes pipes that sucks and discharges the exhaust gas, and a baffle plate that supports the pipes and forms a chamber structure defining a sound-absorbing chamber and a resonance chamber for the exhaust gas. In addition, the muffler may also have a variable valve that is installed on the baffle plate to regulate a discharge amount with the exhaust pressure of the exhaust gas.

The operation of the muffler is as follows: the exhaust gas of the vehicle is introduced into an intake pipe of the muffler, the introduced exhaust gas is discharged to the chamber that is a space partitioned by the baffle plates, and noise is gradually reduced due to interference of sound waves, a reduction in pressure fluctuation, or a reduction in exhaust temperature, while the noise of the exhaust gas passes through the space of the chambers.

In this case, in order to further improve the sound-absorbing effect of the chamber, the internal space of the chamber may be filled using a sound-absorbing material such as glass wool.

Furthermore, an exhaust sound may be variously adjusted by the muffler. Generally, an exhaust sound generated from a sedan is referred to as a limousine exhaust sound, and an exhaust sound generated from a sports car or a coupe is referred to as a sporty exhaust sound.

However, we have discovered that the conventional muffler for implementing the sporty exhaust sound is problematic in that it evenly reduces noise in all RPM regions, so that a sound in a region below a mid-frequency is not increased.

Furthermore, we have found that even though the exhaust system of the vehicle is effective to reduce noise as back pressure increases, an increase in back pressure degrades the power performance of the vehicle. Thus, a tube such as a mid-tube, which can be separately installed to reduce the back pressure, could be considered, but it increases the manufacturing cost.

SUMMARY

The present disclosure provides a muffler for a vehicle, which can increase a sound in a region below a mid-frequency and effectively reduce back pressure, thus implementing a sporty exhaust sound.

According to one aspect of the present disclosure, a muffler for a vehicle includes: a case sealed at both ends thereof by a first side panel and a second side panel; a first baffle plate and a second baffle plate, which are installed in an internal space of the case to be parallel to and spaced apart from each other; a first chamber that is a space formed between the first side panel and the first baffle plate, a second chamber that is a space formed between the first baffle plate and the second baffle plate, and a third chamber that is a space formed between the second baffle plate and the second side panel; an intake tube installed to perpendicularly pass through the first side panel, the first baffle plate, and the second baffle plate, wherein the intake tube includes: an inlet port formed on a first side thereof and configured to allow exhaust gas to enter, an outlet port formed on a second side thereof, a first hole formed in a first body section located in the first chamber, and a second hole formed in a second body section located in the second chamber; and a pair of exhaust tubes installed to perpendicularly pass through the first baffle plate, the second baffle plate, and the second side panel, where each exhaust tube of the pair of exhaust tubes includes: an inflow port formed on a first side thereof and configured to allow the exhaust gas to enter, an outflow port formed on a second side thereof and configured to discharge the exhaust gas introduced through the inflow port to an outside of the case, and a vent hole formed in first body sections of the pair of exhaust tubes, which are located in the second chamber.

A muffler for a vehicle for implementing a sporty exhaust sound according to the present disclosure is advantageous in that exhaust gas introduced into an intake tube is discharged to an outside at high speeds by a pair of exhaust tubes, thus increasing (or maximizing) the amount of the discharged exhaust gas and increasing booming in a region below a mid-frequency, resulting in an excellent effect on implementing the sporty exhaust sound.

Furthermore, the back pressure of the exhaust gas is reduced, so that it is unnecessary to use a separate mid-tube. In addition, a reduction in back pressure can reduce or minimize an effect on power performance.

Furthermore, according to the present disclosure, a sound-absorbing material is filled in a second chamber, thus further reducing a high frequency noise.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIGS. 3A and 3B are diagrams respectively illustrating a first baffle plate, and a second baffle plate of the muffler in one form of the present disclosure;

Figure 7:
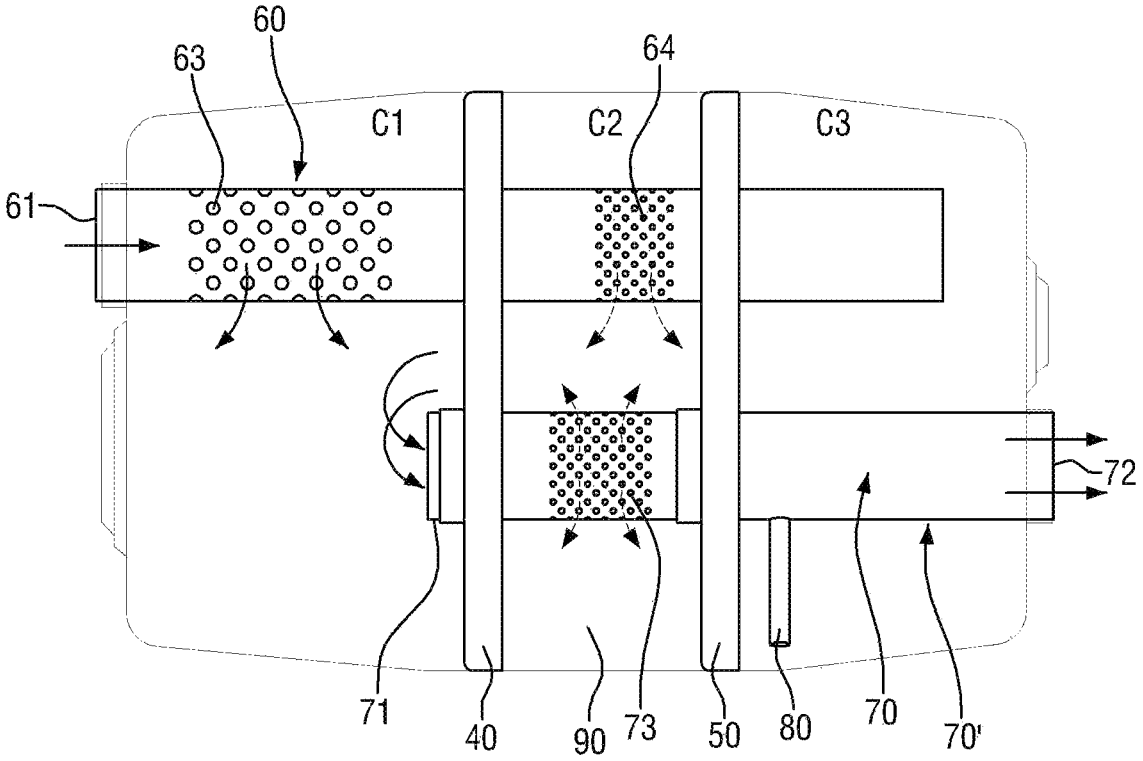
Figure 8A:
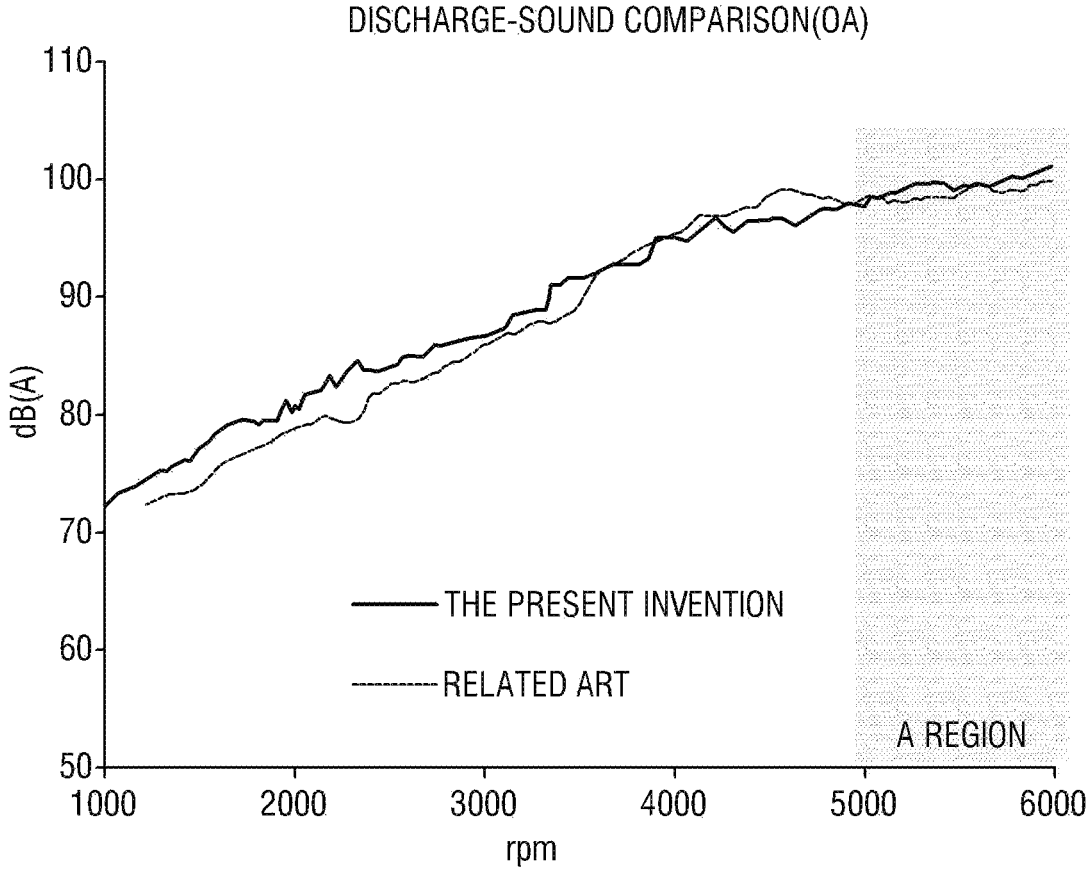
Figure 8B:
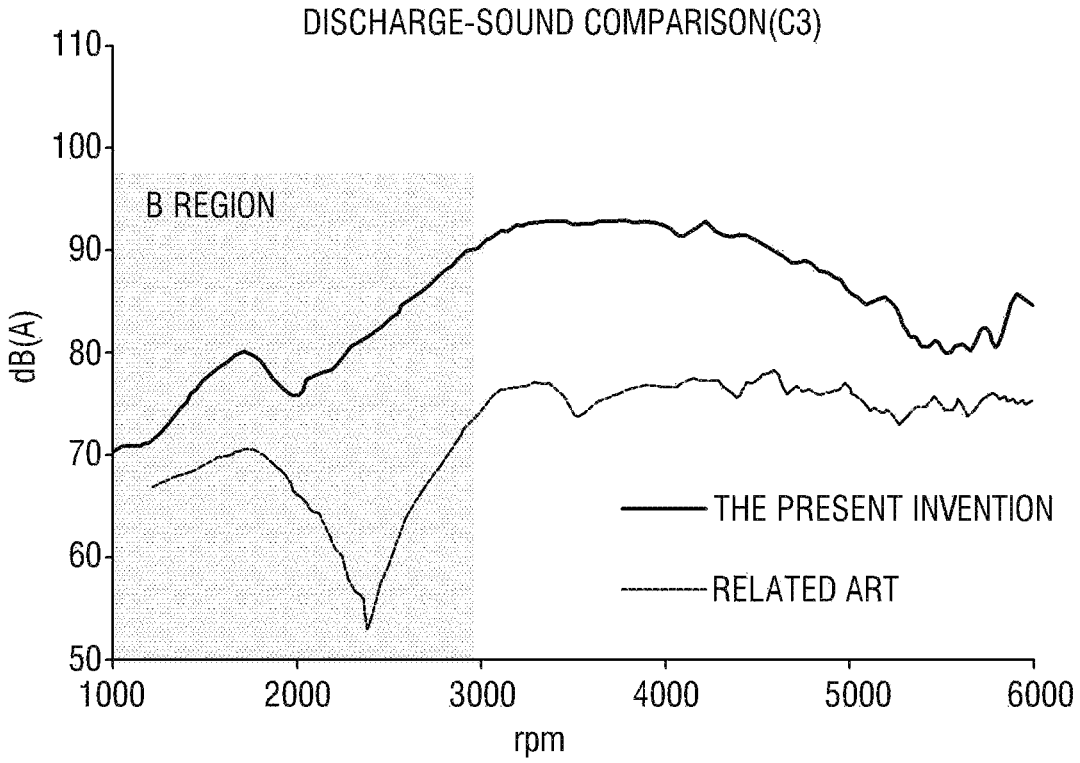
Figure 8C:
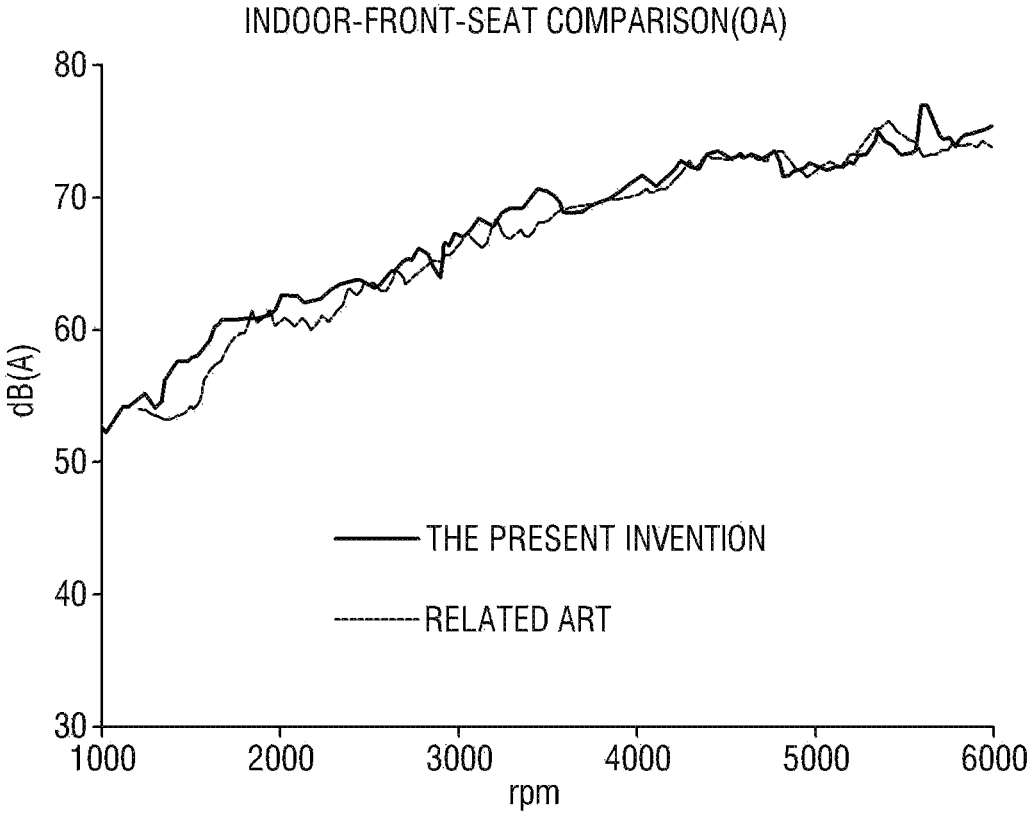
Figure 8D:
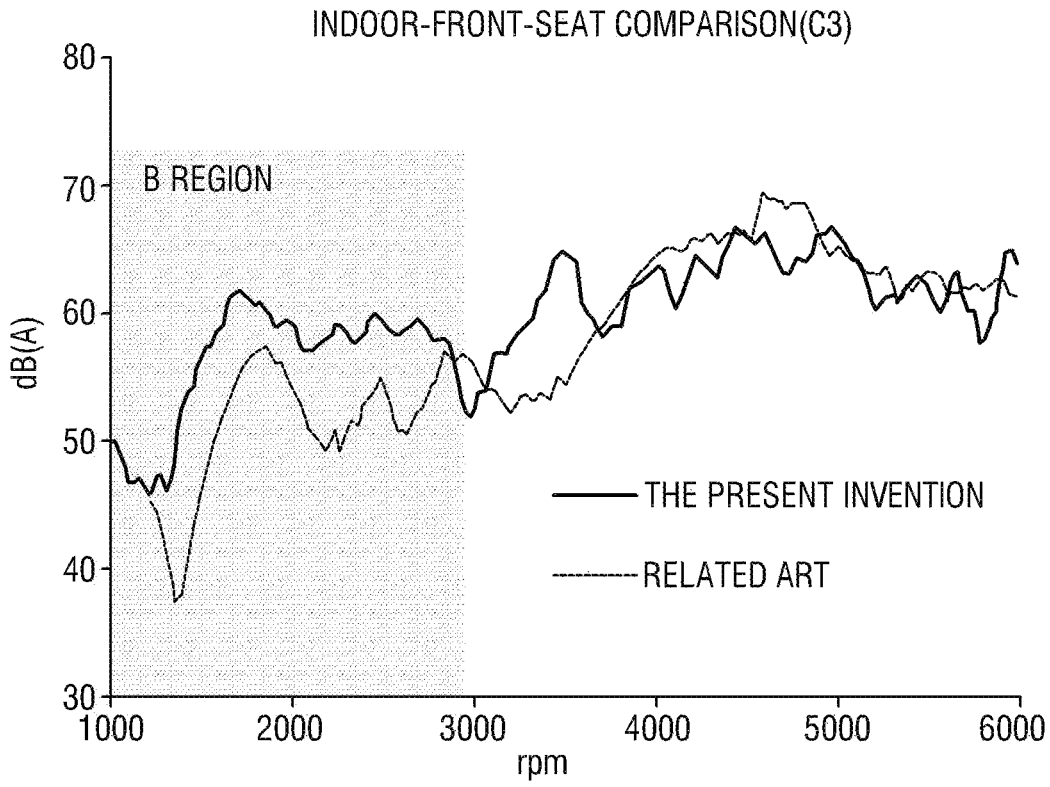

FIG. 7 is a diagram illustrating an operation of the muffler in one form of the present disclosure; and FIGS. 8A to 8D are graphs showing performance of the muffler in one form of the present invention, in which FIG. 8A is a graph of a discharge sound of an OA component, FIG. 8B is a graph of a discharge sound of a C3 component, FIG. 8C is a graph of an exhaust sound in an indoor front seat of the OA component, and FIG. 8D is a graph of an exhaust sound in an indoor front seat of the C3 component.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, the configuration and operation of a muffler for a vehicle for implementing a sporty exhaust sound according to the present disclosure will be described in detail with reference to the accompanying drawings.

However, the disclosed drawings are provided for illustrative purpose to fully convey the spirit of the present disclosure to those skilled in the art. Thus, the present disclosure may be embodied in other aspects without being limited to the accompanying drawings.

Furthermore, unless terms used in the specification of the present disclosure are otherwise defined, the terms have the meanings that are commonly understood by those skilled in the art to which the present disclosure pertains. In the following description and the accompanying drawings, the detailed description of known functions and configurations that may unnecessarily obscure the subject matter of the present disclosure will be omitted.

Figure 1:
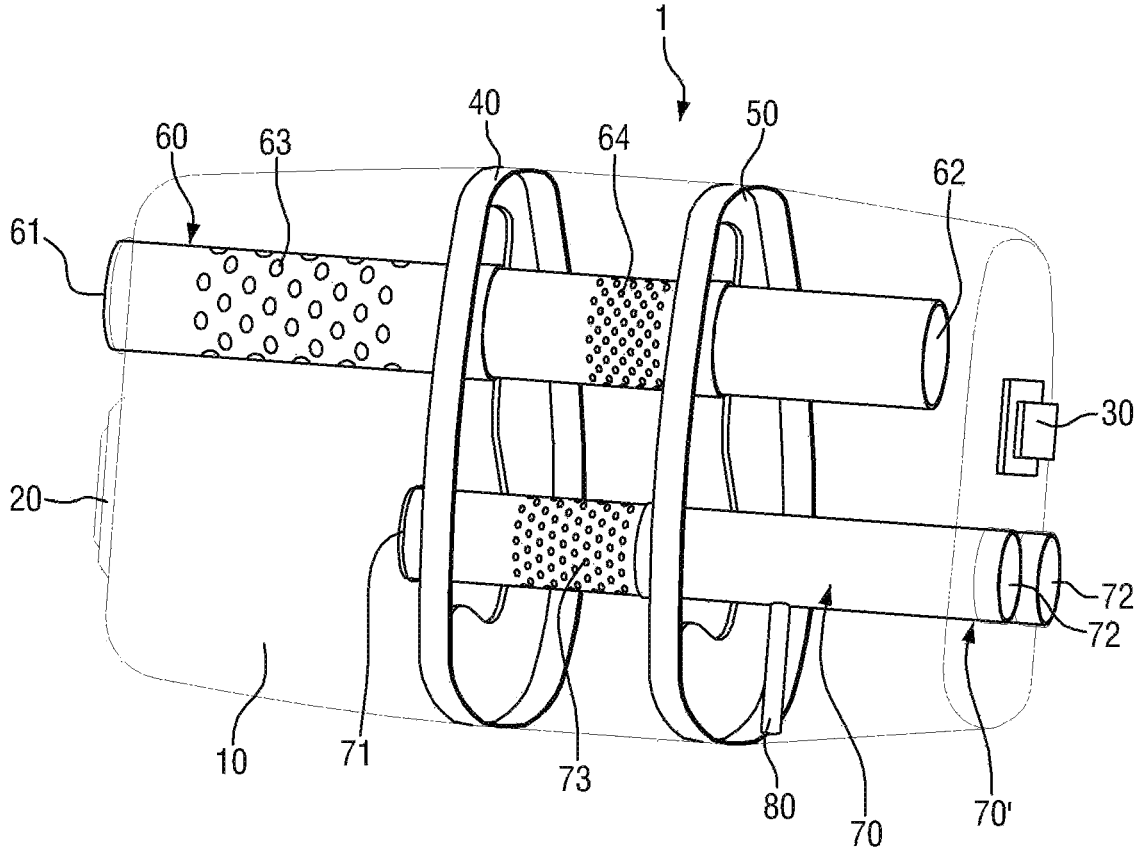
FIG. 1 is a perspective view illustrating an internal structure of a muffler in one form of the present disclosure.
Figure 2:
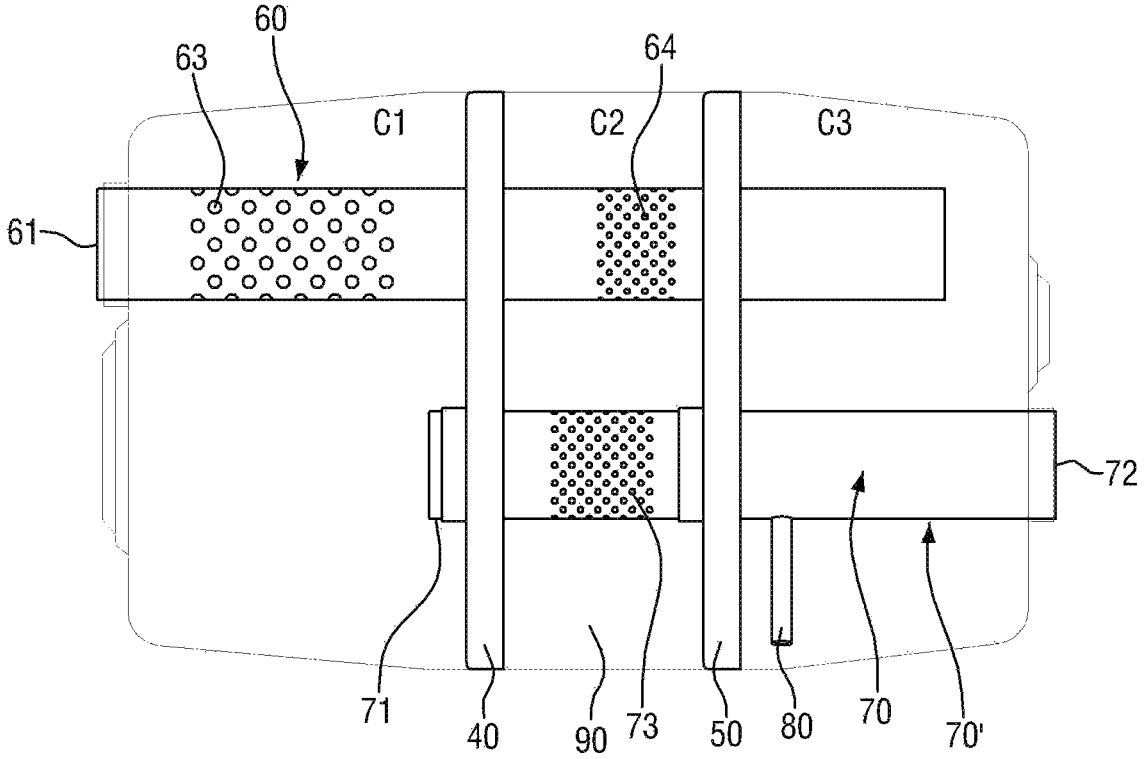
FIG. 2 is a diagram illustrating the internal structure of the muffler in one form of the present disclosure.

FIG. 1 is a perspective view illustrating an internal structure of a muffler in one form of the present disclosure, and FIG. 2 is a plan view illustrating the internal structure of the muffler in one form of the present disclosure.

The muffler 1 for the vehicle in one form of the present disclosure has a case 10 that defines an external appearance. The interior of the case 10 has an internal space of a predetermined capacity.

Both ends of the case 10 are sealed by a first side panel 20 and a second side panel 30.

Two baffle plates, namely, a first baffle plate 40 and a second baffle plate 50 are sequentially arranged in the internal space of the case 10 in a direction from the first side panel 20 to the second side panel 30. The baffle plates are installed to be perpendicular to a longitudinal direction of the internal space of the case 10 while being parallel to and spaced apart from each other.

Furthermore, the internal space of the case 10 is partitioned by the baffle plates 40 and 50. The muffler of the present disclosure includes: a first chamber C1 that is a space formed between the first side panel 20 and the first baffle plate 40, a second chamber C2 that is a space formed between the first baffle plate 40 and the second baffle plate 50, and a third chamber C3 that is a space formed between the second baffle plate 50 and the second side panel 30.

Furthermore, an intake tube 60 and a pair of exhaust tubes 70 and 70' are installed in the internal space of the case 10 of the muffler to be perpendicular to the baffle plates 40 and 50.

Furthermore, a tubular drain 80 is installed in a body of either of the exhaust tubes 70 and 70' to drain condensate water of exhaust gas out of the case 10.

The intake tube 60 is installed to perpendicularly pass through the first side panel 20, the first baffle plate 40, and the second baffle plate 50, thereby being supported by the first side panel 20, the first baffle plate 40, and the second baffle plate 50.

Moreover, an inlet port 61 is formed in one side of the intake tube 60 to allow exhaust gas outside of the case 10 to enter, while an outlet port 62 is formed in the other side of the intake tube 60 to be located in the third chamber C3.

Furthermore, the intake tube 60 has holes to discharge the exhaust gas, flowing through the inlet port 61 into the body, to the internal space of the case 10. To be more specific, a first hole 63 is formed in a section of the tube body located in the first chamber C1 among body sections of the intake tube 60, and a second hole 64 is formed in a section of the tube body located in the second chamber C2 among the body sections of the intake tube 60.

In one form, the diameter of the first hole 63 is up to 5 pi (φ).

Such an intake tube 60 discharges the exhaust gas, introduced through the inlet port 61, through the first hole 63 to the first chamber C1. Continuously, the exhaust gas flowing towards the outlet port 62 is discharged through the second hole 64 to the second chamber C2.

The pair of exhaust tubes 70 and 70' is provided. The exhaust tubes 70 and 70' are installed to perpendicularly pass through the first baffle plate 40, the second baffle plate 50, and the second side panel 30, thereby being supported by the first baffle plate 40, the second baffle plate 50, and the second side panel 30.

Here, the configuration of the exhaust tubes 70 and 70' will be described in detail. However, since the exhaust tubes 70 and 70' have the same configuration, only the configuration of the exhaust tube 70 provided on one side will be described for convenience. The same reference numerals are used for the exhaust tubes 70 and 70'.

The exhaust tube 70 has an inflow port 71 through which the exhaust gas flows, and an outflow port 72 which discharges the exhaust gas introduced through the inflow port 71 to the outside of the case 10. The inflow port 71 is located in the first chamber C1, and the outflow port 72 is located outside of the second side panel 30, so that the exhaust gas introduced through the inflow port 71 into the first chamber C1 is discharged to the outside of the case 10.

In this regard, a plurality of vent holes is formed in a certain section of the body of the exhaust tube 70. The vent holes 73 are formed in the body section located in the second chamber C2 among the body sections of the exhaust tube 70.

Therefore, some of the exhaust gas introduced through the inflow port 71 of the exhaust tube 70 is discharged through the vent holes 73 to the second chamber C2.

Furthermore, the internal space of the second chamber C2 is filled with a sound-absorbing material 90 to effectively reduce a high frequency noise.

In one form, the sound-absorbing material 90 uses glass wool.

Here, a ratio of a total area A1 of all the second holes 64 of the intake tube 60 to a total area A2 of all the vent holes 73 formed in the pair of exhaust tubes 70 and 70' is 1(A1):2(A2). This ratio enables the noise of a high frequency component of the exhaust gas to be further reduced.

Figure 3A:
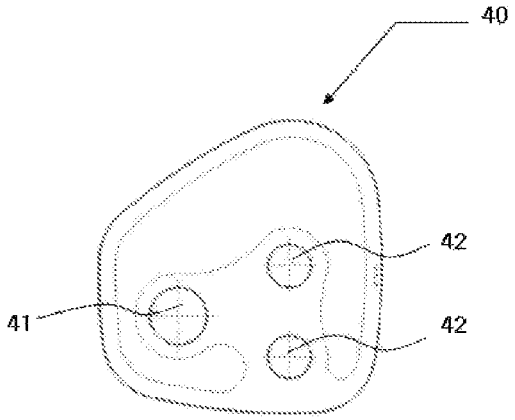
Figure 3A:
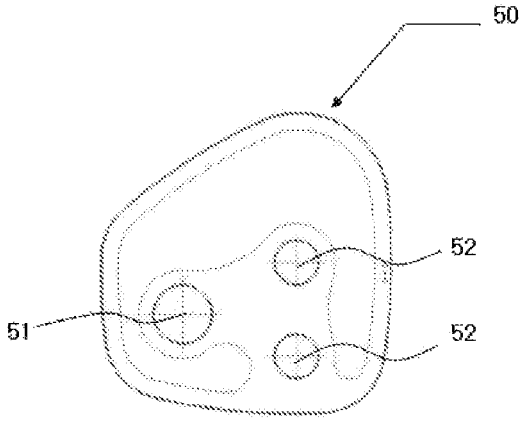

Furthermore, FIGS. 3A and 3B are diagrams illustrating the baffle plates of the muffler in one form of the present disclosure. Referring to FIG. 3A, the first baffle plate 40 has a through hole 41 to insert the intake tube 60 therein, and a pair of through holes 42 to insert the pair of exhaust tubes 70 and 70' therein.

Furthermore, referring to FIG. 3B, the second baffle plate 50 has a through hole 51 to insert the intake tube 60 therein, and a pair of through holes 52 to insert the pair of exhaust tubes 70 and 70' therein.

In this case, the intake tube 60 and the exhaust tubes 70 and 70' are coupled to the first baffle plate 40 and the second baffle plate 50 through a press-fitting method.

Figure 4:
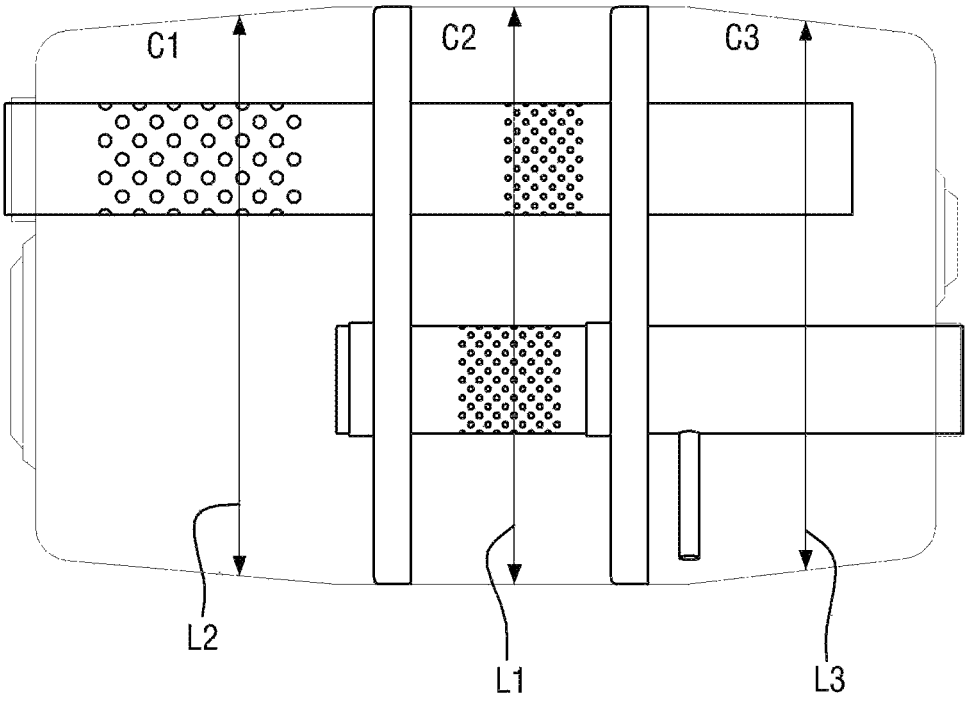
FIG. 4 is a diagram illustrating lengths of respective parts of a case of the muffler in one form of the present disclosure.

Meanwhile, referring to FIG. 4 illustrating lengths of respective parts of the case of the muffler in one form of the present disclosure, the case 10 is formed such that a zone in which the second chamber C2 is located is wider than a zone in which each of the first chamber C1 and the third chamber C3 is located.

That is, a length L1 of a midsection of the zone where the second chamber C2 of the case 10 is located is formed to be larger than a length L2 of a midsection of the zone where the first chamber C1 is located.

Furthermore, the length L1 of the midsection of the zone where the second chamber C2 is located is formed to be larger than a length L3 of a midsection of the zone where the third chamber C3 is located. Such a configuration allows the condensate water to be discharged through the drain 80 installed at the exhaust tube 70 to the outside of the case 10, as soon as the condensate water is produced in the muffler.

Figure 5:
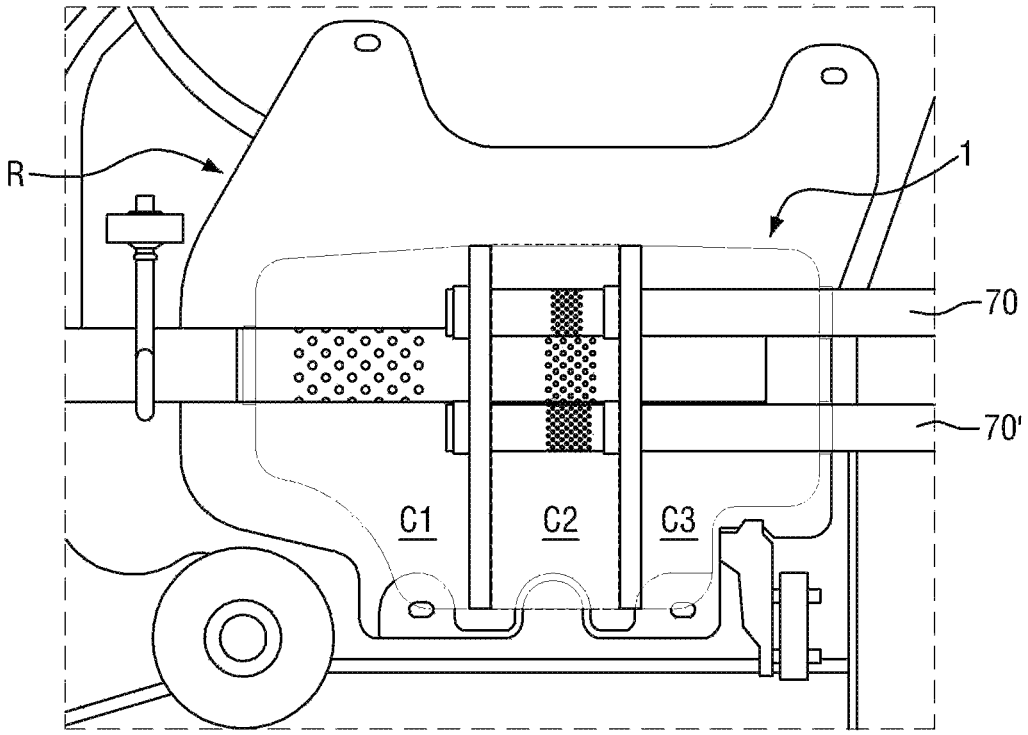
FIG. 5 is a diagram illustrating a state in which a muffler is mounted on a lower end of a vehicle body in one form of the present disclosure.

In one form, referring to FIG. 5 illustrating a state in which the muffler of the present disclosure is mounted on a lower end of a vehicle body, when the muffler 1 is attached to a lower surface of the vehicle body, the second chamber C2 filled with the sound-absorbing material is attached to a central portion on a lower surface of a trunk part R on a lower surface of the vehicle body.

The reason is because the second chamber C2 of the muffler has a low temperature, which reduces the volume of heat transferred to the trunk part via conduction and convection, thereby lowering the temperature of the trunk.

Moreover, because the second chamber C2 of the muffler has the low temperature, it is unnecessary to use separate components such as an insulator on the top of a heat protector that is installed on a conventional muffler.

Figure 6:
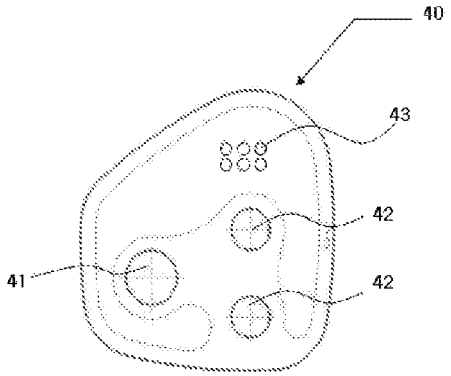
FIG. 6 is a diagram illustrating a baffle plate of a muffler in another form of the present disclosure.

Meanwhile, in FIG. 6 illustrating a baffle plate of the muffler in accordance with another form of the present disclosure, perforated holes 43 may be further formed in the first baffle plate 40 to tune a sporty exhaust sound. The perforated holes 43 may reduce the sporty exhaust sound. The larger a total area of the perforated hole 43 is, the lower the sporty exhaust sound is.

Hereinafter, the operation of the muffler according to one form of the present disclosure will be described in detail.

FIG. 7 is a diagram illustrating the operation of the muffler in one form of the present disclosure.

The exhaust gas introduced through the inlet port 61 of the intake tube 60 of the muffler 1 is discharged through the first hole 63 of the intake tube 60 to the first chamber C1. The exhaust gas discharged to the first chamber C1 flows through the inflow port 71 of the pair of exhaust tubes 70 and 70' into the exhaust tubes 70 and 70', flows along the conduit of the tubes, and then is discharged through the outflow port 72 to the outside of the muffler 1 at high speeds.

Therefore, by increasing or maximizing the amount of the exhaust gas discharged through the exhaust tube 70, booming may be increased in a region below a mid-frequency. Moreover, the back pressure of the exhaust gas is reduced, so that a separate mid tube is not required unlike the related art.

Furthermore, some of the exhaust gas introduced through the intake tube 60 is discharged through the second hole 64 to the second chamber C2, so that the high frequency noise is reduced by the sound-absorbing material 90, such as the glass wool, filled in the second chamber C2.

Furthermore, some of the exhaust gas introduced through the exhaust tube 70 is discharged through its vent holes 73 to the second chamber C2, so that the high frequency noise is reduced by the sound-absorbing material 90 filled in the second chamber C2.

Since the first baffle plate 40 and the second baffle plate 50 defining the space of the second chamber C2 have no hole to permit the passage of the exhaust gas and thus create a sealed space, the exhaust gas is in sufficient contact with the sound-absorbing material 90 filled in the space of the second chamber C2, and the high frequency noise of the exhaust gas is effectively reduced.

In one form, when the glass wool is used as the sound-absorbing material 90, about 400 g of glass wool is used.

Furthermore, as described above, the muffler is set such that the ratio of the total area A1 of all the second holes 64 of the intake tube 60 formed in the space of the second chamber C2 to the total area A2 of all the vent holes 73 formed in the pair of exhaust tubes 70 and 70' in the space of the second chamber C2 is 1:2. Here, if a value of the total area A1 of the second holes 64/the total area A2 of the vent holes 73 is less than ½, the amount of the exhaust gas that is directly discharged through the outflow port 72 of the exhaust tube 70 is excessively larger than the amount of the exhaust gas that is discharged from the second chamber C2 via the vent holes 73, so that the exhaust gas is not in sufficient contact with the sound-absorbing material 90 in the second chamber C2 that is the sealed space, and the ability to reduce the high frequency noise is degraded.

In contrast, if the value of the total area A1 of the second holes 64/the total area A2 of the vent holes 73 is more than ½, an excessive amount of exhaust gas is introduced through the second holes 64 of the intake tube 60 into the second chamber C2, so that the flow of the exhaust gas is stagnant in the second chamber C2, and thereby the ability to reduce the high frequency noise is degraded.

In addition, due to the properties of continuously discharging a larger amount of exhaust gas to the vent holes 73 of the exhaust tube 70, resistance is applied to the exhaust gas that is directly discharged through the exhaust tubes 70 and 70' in the first chamber C1, so that booming is reduced below the mid-frequency.

Meanwhile, the condensate water of the exhaust gas that is produced when being discharged through the exhaust tube 70 is drained through the drain 80 installed at the exhaust tube 70 to the outside of the muffler.

In one form, the muffler has the drain 80 in the internal space of the third chamber C3 serving as a resonance chamber, so as to reduce or minimize the effects of the drain 80 on the performance for reducing NVH.

FIGS. 8A to 8D are graphs showing the performance of the muffler in one form of the present disclosure. In particular, FIG. 8A is a graph of a discharge sound of an OA component, FIG. 8B is a graph of a discharge sound of a C3 component, FIG. 8C is a graph of an exhaust sound in an indoor front seat of the OA component, and FIG. 8D is a graph of an exhaust sound in an indoor front seat of the C3 component.

First, referring to FIG. 8A that is the graph of the discharge sound of the OA component, it can be seen that the discharge sound of the muffler regarding the OA component in region A (region of 5,000 to 6,000 RPM) is comparable to that of the conventional muffler.

Furthermore, referring to FIG. 8B that is the graph of the discharge sound of the C3 component, it can be seen that the discharge sound of the muffler regarding the C3 component in region B (region of 1,000 to 3,000 RPM) is larger than the discharge sound of the conventional muffler, so that the sporty exhaust sound is enhanced.

Furthermore, referring to FIG. 8C that is the graph of the exhaust sound in the indoor front seat of the OA component, it can be seen that the exhaust sound of the muffler regarding the OA component is comparable to that of the conventional muffler.

Furthermore, referring to FIG. 8D that is the graph of the exhaust sound in the indoor front seat of the C3 component, it can be seen that the exhaust sound of the muffler regarding the C3 component in region B (region of 1,000 to 3,000 RPM) is larger than the exhaust sound of the conventional muffler, so that the sporty exhaust sound is enhanced even when measuring indoors similarly to the above-described discharge sound of the C3 component.

Meanwhile, according to the measurement result of the back pressure on a front end of the muffler, when the inflow rate of the exhaust gas is 510 Kg/H, the conventional muffler shows the back pressure of 16.82 kPa, whereas the muffler according to the exemplary forms of the present disclosure shows the back pressure of 12.03 kPa. That is, the back pressure is reduced compared to the related art, thus improving power performance.

What is claimed is:

1. A muffler for a vehicle, comprising:

a case sealed at both ends thereof by a first side panel and a second side panel;

a first baffle plate and a second baffle plate, which are installed in an internal space of the case to be parallel to and spaced apart from each other;

a first chamber formed between the first side panel and the first baffle plate;

a second chamber formed between the first baffle plate and the second baffle plate;

a third chamber formed between the second baffle plate and the second side panel;

an intake tube installed to perpendicularly pass through the first side panel, the first baffle plate, and the second baffle plate, and wherein the intake tube comprises:

an inlet port formed on a first side thereof and configured to allow exhaust gas to enter, an outlet port formed on a second side thereof, at least one first hole formed in a first body section that is located in the first chamber, and at least one second hole formed in a second body section that is located in the second chamber; and a pair of exhaust tubes installed to perpendicularly pass through the first baffle plate, the second baffle plate, and the second side panel, and each exhaust tube of the pair of exhaust tubes comprises:

an inflow port formed on a first side thereof and configured to allow the exhaust gas to enter, an outflow port formed on a second side thereof and configured to discharge the exhaust gas introduced through the inflow port to an outside of the case, and at least one vent hole formed in first body sections of the pair of exhaust tubes, which are located in the second chamber, wherein a ratio of a total area of all of the at least one second hole of the intake tube to a total area of all of the vent holes of the pair exhaust tubes is 1:2.

2. The muffler of claim 1, wherein a drain for condensate water is installed in a second body section of either of the pair of exhaust tubes, which is located in an internal space of the third chamber.

3. The muffler of claim 1, wherein an internal space of the second chamber is filled with a sound-absorbing, material.

4. The muffler of claim 3, wherein the sound-absorbing material comprises glass wool.

5. The muffler of claim 3, wherein when the muffler is attached to a vehicle body, the second chamber filled with the sound-absorbing material is located in a central portion of a trunk part on a lower surface of the vehicle body.

6. The muffler of claim 1, wherein a length of a midsection of a zone where the second chamber is located is larger than a length of a midsection of a zone where the first chamber is located, and the length of the midsection of the zone where the second chamber is located is larger than a length of a midsection of a zone where the third chamber is located.

7. The muffler of claim 1, wherein a perforated hole is formed in the first baffleplate and configured to tune a sporty exhaust sound.

* * * * *